United States Patent [19]

Ryckman, Jr.

[11] 4,283,701

[45] Aug. 11, 1981

[54] OVERSHOOT COMPENSATED THERMOSTAT

[75] Inventor: William D. Ryckman, Jr., Asheboro, N.C.

[73] Assignee: General Electric Company, New York, N.Y.

[21] Appl. No.: 31,979

[22] Filed: Apr. 20, 1979

[51] Int. Cl.[3] ..... H01H 37/52

[52] U.S. Cl. ..... 337/341; 337/370

[58] Field of Search ..... 337/37–40, 337/81, 82, 84, 335, 336, 341, 347, 349, 360, 370, 371; 219/252; 38/77.7

[56] References Cited

U.S. PATENT DOCUMENTS

| | | | |
|---|---|---|---|
| 2,249,837 | 7/1941 | Lee | 337/360 |
| 2,284,383 | 5/1942 | Elmer | 337/101 |
| 2,742,547 | 4/1956 | Tsai | 337/336 |
| 3,023,287 | 2/1962 | Epstein | 337/96 |
| 3,593,253 | 7/1971 | Taylor | 337/379 |
| 3,936,792 | 2/1976 | Senor et al. | 337/349 |
| 4,045,894 | 9/1977 | Toft et al. | 38/77.83 |

*Primary Examiner*—William H. Beha, Jr.

*Attorney, Agent, or Firm*—John F. Cullen; George R. Powers; Leonard J. Platt

[57] ABSTRACT

A thermostat assembly to control heat to an iron soleplate, includes a bimetal blade on a soleplate boss responding to the heat thereto to make and break the electric circuit. To this standard construction an improved thermostat assembly uses a slot in the bimetal blade adjacent its free end, the slot extending partially across the blade at right angles to the longitudinal axis with a second compensating blade deforming in the opposite direction and secured to the first blade between the slot and free end with the axes of deformation of the blades oriented at right angles to each other such that the cross slot provides delay in heat conduction so the contacts first open at a lower main blade temperature than subsequent openings to reduce overshooting of the temperature in the iron soleplate.

9 Claims, 3 Drawing Figures

OVERSHOOT COMPENSATED THERMOSTAT

BACKGROUND OF THE INVENTION

1. Field of the Invention

The invention herein pertains to a thermostat assembly and especially to one as applied to an extra capacity small steam iron with its surge boiler in the rear of the iron and a thermostat mount providing close direct connection to an adjacent contoured outside iron surface. The thermostat is constructed to reduce size and sensitivity in calibration and temperature overshoot by providing a built-in delay for substantially uniform soleplate temperature.

2. Description of the Prior Art

Many irons, steam or dry, provide a mounting for a temperature controlling thermostat where the mount comprises a boss on the soleplate creating a heat sink or collecting conductor to sense temperature and a thermostat is mounted on the boss to react to temperature changes required by various manual settings. Generally, in an iron the thermostat is mounted centrally or in the forward portion of the soleplate to detect the hottest part and react accordingly.

Recent developments have produced lightweight, smaller plastic irons at a lower price while retaining many of the standard features for dry, steam, and surge operations and these smaller irons have presented problems in fitting the usual thermostats to obtain satisfactory results. A typical iron of this general type is shown in U.S. Pat. No. 3,986,282 which iron uses a rear surge generator that required a revision in design from usual larger irons simply because there is not enough room in the small lightweight iron for all the parts to supply the various features. An improvement that provides an iron structure eliminating some linkages and using a direct thermostat coupling through the side of the iron is shown in U.S. Pat. No. 4,045,894 and both patents are of common assignment. The arrangement of these patents provides limited space for the thermostat mount at the soleplate creating calibrating difficulties and a compensated type thermostat must be used to minimize temperature overshoot. Available thermostats are simply not adequate in such setting to be sensitive in calibration with minimum overshoot. Thus, the main object of the invention is to provide a thermostat assembly as may be used in a small iron that reduces calibration sensitivity in a smaller envelope while reducing temperature overshoot for uniform soleplate temperature.

DESCRIPTION OF THE PREFERRED EMBODIMENT

The present invention will be described in connection with a small lightweight plastic iron since it is especially applicable to such use although, the thermostat assembly may be applicable per se to other uses than small irons. Also, the invention represents an improved version of the parent structure shown in U.S. Pat. No. 4,045,894 supra and reference is made thereto for more complete description of the iron as repeated herein.

Figure 1:
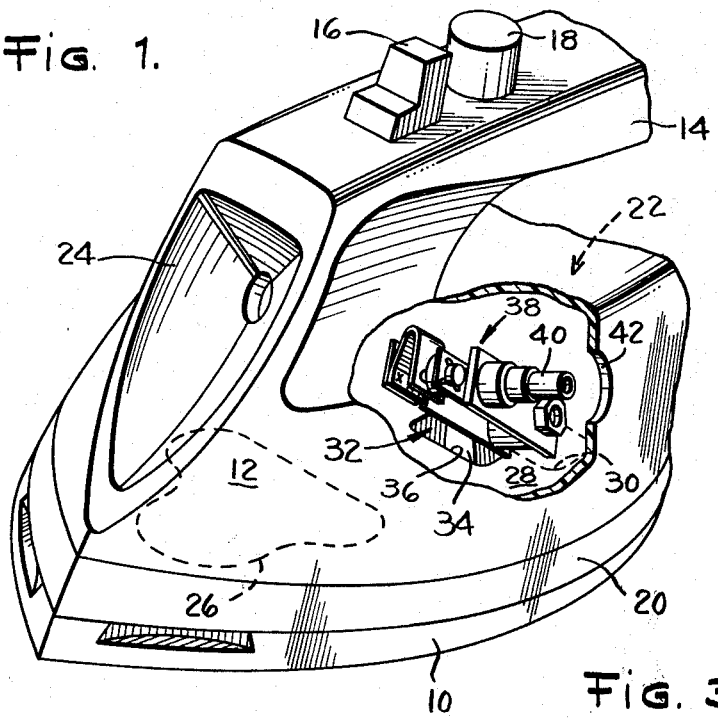
FIG. 1 is a broken perspective of a typical iron broken away to show the thermostat assembly.

Referring to FIG. 1 there is shown a small lightweight plastic iron for steam and extra surge capacity having a soleplate 10 with conventional steam ports, a one-piece molded plastic contoured housing 12 formed with handle 14 and having conventional steam button 16 and extra surge button 18. A separate plastic skirt 20 isolates housing 12 from hot soleplate 10 and an internal water tank or reservoir in the general location of 22 is filled through opening 24. A conventional stabilizing bar may steady the iron in its heel rest position and may be used to wind the electrical cord as described in said U.S. Pat. No. 4,045,894.

Because of the compact arrangement of the iron, smaller than the conventional iron and lighter weight due to its plastic construction, the use of a conventional forward handle thermostat or saddleplate control under handle 14 is difficult because of internal water tank 22. To overcome this, a side thermostat button is provided to set the desired iron temperature in the compact arrangement and is mounted on the contoured side of housing 12.

To provide normal steam, a forward main generator 26 receives water drops when button 16 is in the up position as is well known. The resulting steam is directed through suitable passages, formed between the soleplate 10 and coverplate 28, to exit the usual ports in the soleplate. For an extra surge of steam, a rear surge generator 30 is disposed in the rear half of the iron so that, if desired, water may be selectively directed to it in the iron heel rest position to provide surge steam in the vertical position or vertical steaming may be omitted and rear generator 30 used merely to provide an extra surge of steam in excess of that produced in main generator 26 with the coverplate 28 and soleplate 10 defining steam distributing means from both generators 26 and 30.

In order to provide a suitable heat regulating thermostat arrangement in an iron of such small lightweight size and different internal structure from a conventional iron, there is provided a walled enclosure between the generators on the soleplate as generally indicated at 32, and defining a separate area disposed in the rear portion of the iron to hold and locate an upstanding integral boss 34 that is an integral part of the soleplate for good heat conduction therefrom.

In order to accommodate the enclosure and boss, coverplate 28 has a corresponding opening 36 that fits snugly around the top of the walled enclosure 32 so the enclosure extends through the coverplate opening to be flush therewith as seen in FIG. 1. The thermostat generally indicated at 38, is mounted on the side of boss 34 with its operating shaft 40 angled through an opening 42 in the side of housing 12 where a suitable thermostat knob is attached for setting the desired temperature. This arrangement eliminates complex linkage structure in a small iron, provides good heat conduction, rapid response, and uniform soleplate temperature all as completely described in said U.S. Pat. No. 4,045,894.

Because of the limited space in the small type iron described and the point at which the thermostat must be mounted to the soleplate on boss 34, it is necessary that a compensated type thermostat be used to minimize temperature overshoot. Such commercially available thermostats use a short main bimetal blade with a reversed compensating bimetal welded to the free end of the main blade. Since the two bimetals oppose each other, the net movement of the free end actuating the contacts is very small. This makes the thermostat quite sensitive to calibrate accurately and small dimensional changes, that may result from electric contact wear, result in large changes in temperature setting. This presents problems in mass production and an unsatisfactory wait, albeit small, for the iron to settle down to a uniform soleplate temperature.

Figure 2:
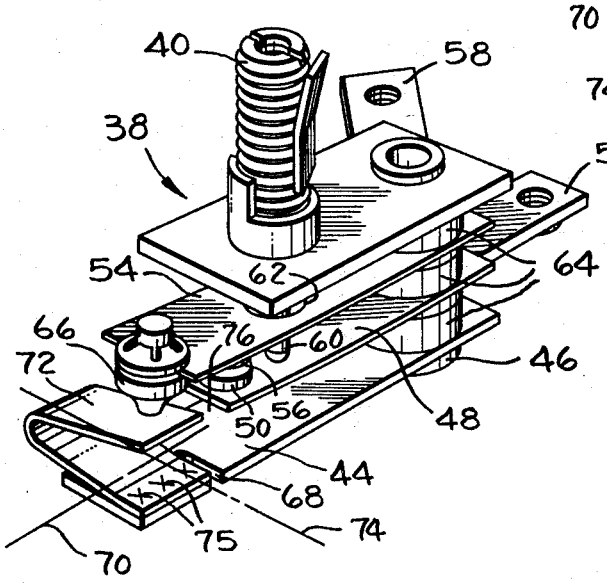
FIG. 2 is an enlarged perspective of the assembled thermostat.
Figure 3:
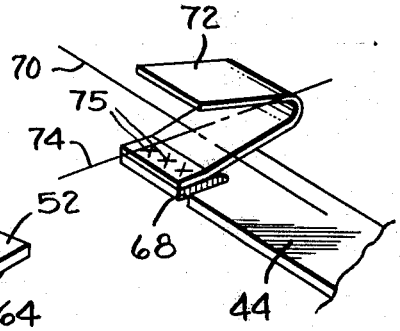
FIG. 3 is a partial perspective of the compensating and delay structure of the invention.

In accordance with the invention as shown in FIGS. 2 and 3, the thermostat design disclosed herein reduces the sensitivity on calibration by a factor of approximately 3 and also greatly reduces the temperature overshoot on initial heat up. The thermostat 38 is similar to many compensated type thermostats in having a first main bimetal blade 44 which, for the purposes of the iron of FIG. 1, may be a multi-layered trimetal with a copper inner layer for faster heat response, the blade being a rectangular blade supported from a mounting post 46 at one end, the mounting post being held in tight contact with boss 34 as shown in FIG. 1 to sense soleplate temperature in the normal fashion. Spaced above bimetal 44 is a second upwardly biased arm 48 that carries one of a pair of contacts 50 which is connected through arm 48, terminal 52, the heating element, and then connected to one side of the power line for heating the iron. Above arm 48 is a third arm 54 that carries a second contact 56, which in turn, leads to the other terminal 58 and to the other side of the power line. All of the arms are insulated from one another by insulating members 64. A different temperature is set by rotating shaft 40 to move an extended insulating probe 60 through an opening 62 in arm 54 thus changing the position of biased arm 48 which, in turn, changes the amount of movement required of bimetal blade 44 such that clockwise rotation of shaft 40, with its conventional left hand thread, results in a higher temperature before contacts 50 and 56 open to cut off the electric heating means to the soleplate. This structure is well known in the usual operating bimetal type thermostat. As previously noted, commercially available thermostats use a main bimetal similar to 44 except shorter with a reversed compensating bimetal at the free end so the net movement is small since the main short portion bends upward as the temperature rises while its compensating or free end bends down. The net movement is transmitted to contact arm 54 by a suitable insulator such as 66 that is normally actuated by the compensating blade at the end of the conventional bimetal.

As previously noted, this standard construction with small net movement makes the thermostat sensitive to calibrate and any dimensional changes such as wear on contacts 50 and 56 result in large changes in temperature setting. Additionally there is a tendency of the compensating bimetal to bend downward too rapidly, and thus allow overshoot on initial heat up. To avoid this, in accordance with the invention conventional bimetal blade 44 is provided with a suitable opening or cut-out means such as, for example, preferably a single narrow slot 68 that extends partially across the blade at or substantially adjacent its free end. The depth of the slot may be varied to change the timing of the compensation and will depend upon the particular application as will become apparent. As seen, the slot is cut substantially at right angles to the longitudinal axis of deformation 70 of bimetal 44. The purpose of the slot is to isolate the free end portion of bimetal 44 and cause a slight delay in heating the end portion. Thus, the end portion heats a little later than normal or after a slight delay on initial heat up. If a longer delay is desired the slot will be made deeper or it will be made shallower for a shorter delay. The present thermostat is also equipped with a compensating bimetal blade 72 that is U-shaped as shown. This blade is oppositely deformable from blade 44 i.e. as 44 rises under application of heat, the U of compensating blade 72 tends to close resulting in a net overall smaller movement transmitted to contact 56 through insulator 66.

In order to keep the overall length of the thermostat short for its confined smaller envelope mounting in the iron, it is important that the compensating blade 72 be disposed between slot 68 and the free end of blade 44 and be mounted crosswise or with its axis of deformation 74 at right angles to the longitudinal axis of deformation 70 of blade 44. This minimizes the overall longitudinal length of the entire thermostat while permitting a relatively long main bimetal 44 length as well as a long length for the right angle compensating blade 72 resulting in a greater contact movement in a small envelope making for easier calibration and reducing drift due to contact wear. Bimetal movement is transmitted through insulator 66, which rests on the end of blade 72, operatively connecting the blade to contact 56.

In order to delay the heat reaching the compensating blade 72 while having the main blade 44 quickly responsive to temperature changes, these oppositely deformable blades are primarily disposed on opposite sides of the slot with the compensating blade 72 being secured on the free end of blade 44 as seen in FIGS. 2 and 3. To transmit the heat in blade 44 to the compensating blade, the blade 72 is secured to the free end portion of blade 44 by welding along one leg of the U at welds 75 along a line that is at right angles to deformation axis 74 and parallel to longitudinal axis 70 to insure a good contact directly adjacent the slot as shown. Additionally, the blades are welded together on their opposite expansion sides for proper compensation. In other words, the upper low expansion surface of blade 44 and the outer high expansion opposite surface of compensating blade 72 are welded such that blade 44 rises as heat is supplied and the U-shaped blade 72 closes to compensate. Thus, blade 44 has essentially a first elongated flat portion to the right of the slot that responds primarily to the heat to deform in the up direction and a second free end portion secured to the end of the first portion on the left of the slot which operates in conjunction with blade 72 to give a compensating or downwardly deforming motion to insulator 66. To delay the timing of the compensation, the depth of the slot in the main bimetal blade 44 may be increased and the amount of the compensation can be changed by changing the dimensions of the compensating blade 72 or vice versa. It is to be noted that neither of these adjustments has much effect on the steady state operation after initial heat up. The right angle or 90° axis relationship of the compensating blade 72 on main blade 44 shortens the overall envelope of the thermostat while keeping the compensating blade 72 safely clear of the middle contact arm 48 to prevent shorting thereto because of the large space 76 between the two. As noted above, the assembly provides greater contact movement for a given temperature change because of the increased length of main bimetal 44 making the thermostat easier to calibrate and it lessens the drift due to wear or contact erosion. It allows most of the heating of the compensating blade 72 to occur after the first opening of the electrical contacts 50 and 56, the effect being to cause the first opening of the contacts to occur at a lower main bimetal 44 temperature than subsequent openings. This early opening on the first cycle substantially reduces the overshoot.

Thus, my invention provides a thermostat and especially a thermostat in an iron combination that is significantly shorter in its overall envelope while still using elongated temperature responsive blades for greater contact movement for a given temperature change because of the increased length. The thermostat is easier to calibrate and lessens drift due to contact wear while delaying initial transmission of heat by its slot to reduce any overshoot in the iron soleplate temperature.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a thermostat assembly having contacts for making and breaking an electrical circuit to control heat to a medium and using a heat deformable blade composed of first and second oppositely deformable portions supported at one point and operably connected to one of said contacts spaced from the support, the improvement comprising, an opening in said deformable blade and having said deformable portions primarily disposed on opposite sides of said opening and mounted with their main axes of deformation substantially at right angles to each other, said opening disposed between the support and the operative connection, whereby conduction of heat to the operative connection is delayed by said opening.

2. Apparatus as described in claim 1 wherein the first portion of said heat deformable blade is substantially a flat elongated blade deformable along a longitudinal axis and said second oppositely deformable compensating portion is U-shaped and secured on one end of said first portion.

3. Apparatus as described in claim 2 wherein said second U-shaped compensating portion is secured to said first portion along a line parallel to said longitudinal axis and at substantially right angles to the axis of deformation of said U-portion.

4. Apparatus as described in claim 3 wherein said oppositely deforming portions are secured to each other on their opposite expansion sides.

5. In a thermostat assembly having contacts making and breaking an electric circuit controlling heat to a medium and having a first flat bimetallic blade supported at one end and heat deformable along its longitudinal axis and operatively connected at its free end to one of said contacts, the improvement comprising;

a slot in said first blade adjacent the free end, said slot extending partially across the blade substantially at right angles to said longitudinal axis, a second oppositely deformable compensating blade secured to said first blade between said slot and free end, the axes of deformation of said blades being disposed substantially at right angles to each other, whereby heat conduction to the operative connection is delayed by said slot.

6. Apparatus as described in claim 5 wherein said oppositely deformable blades are primarily disposed on opposite slides of said slot.

7. Apparatus as described in claim 6 wherein said second deformable compensating blade is U-shaped and secured on said free end of said first blade.

8. Apparatus as described in claim 7 wherein said second compensating U-blade is welded along one leg of the U to the free end of said first blade and along a line parallel to said longitudinal axis.

9. Apparatus as described in claim 7 wherein said first and second blades are welded together on their opposite expansion sides.

* * * * *